United States Patent [19]

Monsheimer et al.

[11] 4,314,801

[45] Feb. 9, 1982

[54] SOAKING METHOD

[75] Inventors: Rolf Monsheimer; Ernst Pfleiderer, both of Darmstadt, Fed. Rep. of Germany

[73] Assignee: Röhm GmbH, Darmstadt, Fed. Rep. of Germany

[21] Appl. No.: 201,049

[22] Filed: Oct. 27, 1980

[30] Foreign Application Priority Data

Nov. 3, 1979 [DE] Fed. Rep. of Germany ..... 2944462

[51] Int. Cl.[3] ..... C14C 1/04

[52] U.S. Cl. ..... 8/94.14; 435/265

[58] Field of Search ..... 8/94.14; 435/265

[56] References Cited

U.S. PATENT DOCUMENTS

| | | | |
|---|---|---|---|
| 2,212,750 | 8/1940 | Pfannmuller et al. | 435/265 |
| 3,986,926 | 10/1976 | Monsheimer et al. | 195/6 |

FOREIGN PATENT DOCUMENTS

| | | |
|---|---|---|
| 288095 | 11/1914 | Fed. Rep. of Germany . |
| 2059453 | 12/1970 | Fed. Rep. of Germany . |
| 2301591 | 7/1974 | Fed. Rep. of Germany . |
| 452630 | 8/1936 | United Kingdom . |
| 455603 | 10/1936 | United Kingdom . |
| 455697 | 10/1936 | United Kingdom . |
| 1450231 | 9/1976 | United Kingdom . |
| 128096 | 9/1960 | U.S.S.R. . |

OTHER PUBLICATIONS

Fermente, Hormone, Vitamine, vol. I, Georg Thieme Verlag, Stuttgart, 1959, pp. 301-302.
Kirk-Othmer, Encyclopedia of Chemical Technology, vol. 8, Interscience (1952) pp. 294-295.
Chem. Abstr. 52, 17771.
Chem. Abstr. 54, 23393.
Chem. Abstr. 59, 11769.
Chem. Abstr. 61, 851.
Chem. Abstr. 75, 65321y.
Chem. Abstr., 84, 166290d.
Chem. Abstr., 84, 32623f.

*Primary Examiner*—Maria Parrish Tungol
*Attorney, Agent, or Firm*—Curtis, Morris & Safford

[57] ABSTRACT

What is disclosed is a method for soaking dried or salted fur pelts which comprises soaking said pelts in an aqueous bath containing at least one compound selected from the group consisting of compounds of the formula

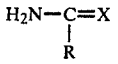

and acid addition salts of such compounds, wherein R taken alone is —H, —$NH_2$, —$CH_3$, or —NHCN, X taken alone is =O, =S, or =NH, and R and X taken together form a five- or six-membered heterocyclic ring having conjugated double bonds therein and containing only nitrogen as a hetero atom.

11 Claims, No Drawings

SOAKING METHOD

The present invention relates to a method for soaking dried or salted fur pelts.

When preserving a skin with salt, and during storage, water is removed from the skin. The skin becomes harder during this treatment. The original softness and pliability are returned to the skin if, by immersing and agitating it in water, the salts are again dissolved out of the skin fiber structure and the fibers can again absorb water. At the same time, in this "soaking", further cleaning of the skin is achieved, by which protein materials soluble in neutral salts leave the skin.

The soaking process is supported by the addition of small amounts of alkali, as well as by the addition of soaking auxiliaries. Nevertheless, the pH value of the soaking bath must always remain below 12.0 so that the hair is not "immunized", [cf. Ullmann's Encyclopaedie der Techn. Chemie ("Ullmann's Encyclopedia of Technical Chemistry") 4th Edition, Vol. 6, page 118, Verlag Chemie 1978]. The "soaking agents" for the most part are surface active or boundary active materials comprising alkyl sulfates, alkylaryl sulfonates, or ethylene oxide derivatives.

A process for soaking skins and hides at a pH value between 10 and 12 in the presence of bacterial proteinases or fungal proteinases having an activity maximum against casein at a pH value between 10 and 12 is known in the prior art.

The present invention has as its goal the soaking of fur pelts. Compared with the soaking of skins for the preparation of leather, hair looseness and damage to the relatively thin-skinned material brought about by bacterial growth are matters which come to the foreground. Thus, an extended soaking must be avoided. The most suitable temperature is 15° C.–18° C.; 1–2 days are the most extensive soaking period. Thus, the effect of certain neutral salts in promoting swelling is utilized for shortening the soaking period, which salts having a peptizing effect at low concentrations. [c.f. F. Stather, Gerbereichemie und Gerbereitechnologie ("Tanning Chemistry and Tanning Technology"), 4th Edition, page 828, Akademie-Verlag, Berlin, 1967]. However, the effect of weak alkali salts in promoting swelling is disadvantageous in the soaking of pelts for the dressing of furs, since a slight alkalinity of the soaking water favors proteolytic protein decomposition and stronger alkalinity disadvantageously influences the sheen of the hairs. On the other hand, the use of surface active materials in the soaking of pelts is emphatically recommended.

It has now been found that the soaking step for fur pelts can be considerably improved if compounds of the formula $$H_2N-\underset{\underset{R}{|}}{C}=X,$$

alone or together with the acid addition salts derived therefrom, are added to the aqueous bath, in which compounds R taken alone is hydrogen, $-NH_2$, $-CH_3$, or $-NHCN$, X taken alone is $=O$, $=S$, or $=NH$, or X taken together with R forms a five- or six-membered heterocyclic ring which has conjugated double bonds (i.e. partially hydrogenated heterocycles are excluded) and contains only nitrogen as a hetero atom and preferably contains further amino substituents. Also, several compounds of the aforementioned formula can be used in combination.

Urea, guanidine, dicyandiamide, melamine, or acid addition salts derived therefrom are particularly mentioned as compounds of the aforementioned formula, as well as thiourea, thioacetamide, acetamide, formamide, cyanourea, aminopyridine, aminopyrimidine, aminotriazole, aminoimidazole, and aminoindole.

Acid addition salts are primarily used for such compounds of the aforementioned formula which per se react basically, for example compounds having the structural unit $$-N=\underset{|}{C}-NH_2.$$

As acids suitable for the formation of addition salts, mineral acids such as hydrochloric acid and sulfuric acid are particularly suitable, but also organic acids such as acetic acid or propionic acid and the like can be used. The concentration of the compounds of the aforementioned formula in the soaking batch can be between 0.0075 and 0.1 mol per liter, preferaby between 0.01 and 0.085 mol per liter, and particularly preferably between 0.025 and 0.085 mol per liter. Otherwise, the process of the present invention can be carried out extensively according to the soaking processes of the state of the art.

The soaking method of the present invention can, for example, be carried out in such a manner that salted or dried pelts are introduced into soaking water that contains one or more compounds of the aforementioned formula, preferably in the concentrations given, suitably using vessels employed for dressing pelts, such as paddles, drums, vats, mixers, etc. The soaking method is supplemented and accelerated by mechanical agitation. Further, the soaking water may contain surface active additives known in the art, particularly fat emulsifying additives such as fatty alcohol sulfates, in conventional concentrations. The soaking method corresponding to the present invention can be carried out at pH values between 8,5 and 11, and preferably between 9.0 and 10.8. In order to preserve the hair as extensively as possible, the tendency is not to let the pH value become too alkaline, i.e. to work in a weakly alkaline bath rather than a strongly alkaline bath.

It a preferred embodiment, the soaking method can be carried out in a bath which contains enzymes suitable for the soaking method in addition to compounds of the aforementioned formula. Preferably, the enzymes are proteolytic enzymes. A combination of compounds of the aforementioned formula together with alkaline proteinases is particularly preferred.

The pH values of the remaining boundary conditions are in such cases suitably conformed to the activity conditions of the enzyme, keeping in mind the aforementioned precautions pertaining to the softening method.

The use according to the invention of the compounds of the aforementioned formula together with alkaline proteinases at a pH value between 9.0 and 10.8 is particularly preferred, wherein, as proteinases, principally serine proteases come into consideration. By serine proteinases are meant that group of animal and bacterial endopeptidases which have a serine residue in a catalytically active center (cf. Lexikon Biochemie, Verlag Chemie Weinheim, 1976, pages 512–513). Above all, the proteinases of the Bacillus type should be mentioned, such as *B. subtilis, B. licheniformis, B. firmus, B. alcalophilus, B. polymixa, B. mesenthericus,* etc. In general, one can start from an enzyme activity which is between 8,000 and 10,000 Loehlein-Volhard units (LVU) per gram of enzyme. In general, amounts of proteinase between 0.02 and 1.0 g, preferably from 0.05 to 0.75 g, and particularly preferably from 0.05 to 0.5 g per liter of soaking bath are sufficient.

The advantages of the method according to the present invention are noticeable inter alia in a surprisingly short duration of the soaking process. Thus, in general, 2–6 hours are sufficient for salted pelts and 10 to 15 hours, as a rule 12–14 hours, are sufficient for dried pelts in order to provide softened products of outstanding quality. Of course, as known to those skilled in the art, the kind and quality of the pelts have a decisive influence on the soak time so that there are exceptions to the aforementioned average values.

In contrast to the negative expectations to which the state of the art gave cause, the effect of compounds of the aforementioned formula in the soaking does not lead to a loosening of wool or hair, but rather to particularly suitable pelts. A detectable loosening of the fiber structure is attained, which makes itself evident by an improved softness and pliability of the pelts as compared with the products of conventional soaking methods.

Further, it must be considered as extremely surprising that there is a mutual strengthening of the effect of the enzyme and the effect of the compounds of the aforementioned formula. Because of this synergistic effect, it is possible to maintain the dosage of enzyme at an order of magnitude of about 50 percent of the enzyme normally employed, with improved efficacy.

In the soaking process according to the present invention, additives known per se, such as activators, stabilizers, and optional buffers, can be added to the enzymatic batch. The proteolytic activity of enzymes is conventionally determined according to the Anson hemoglobin method [M. L. Anson, J. Gen. Physiol. 22, 79 (1939)] or according to the Loehlein-Volhard method as Loehlein-Volhard units (LVU) [die Loehlein-Volhard'sche Methode zur Bestimmung der proteolytischen Aktivitaet ("The Loehlein-Volhard Method for Determining Proteolytic Activity"), Gerbereichem. Taschenbuch, Dresden-Leipzig 1955]. One Loehlein-Volhard unit is that amount of enzyme which, under the specific conditions of the method, digests 1.725 mg of casein.

The use of enzymes of Aspergillus and/or Streptomyces types according to the present invention is preferred. *Asperigillus oryzae, A. flavus, A. saitoi, A. parasiticus,* and *Streptomyces griseus* are mentioned inter alia. The use of several enzymes in combination can be particularly advantageous, for example the use of alkaline bacterial proteinase together with alkaline fungal proteinase within the limits on amounts set forth above.

A better understanding of the present invention and of its many advantages will be had by referring to the following specific Examples, given by way of illustration.

EXAMPLE 1

100 salted sheep skins are soaked for four hours with water at an inlet temperature of 28°–30° C. in a weight ratio of 1:8. 3.0 g of dicyandiamide are added per liter of soaking bath. Every hour, the batch is agitated for five minutes. The pH value of the bath is 10.5 at the beginning and 9.5 at the end. The sheep skins are nicely softened. No looseness of the wool could be determined. After fleshing, the skins can be pickled and dressed.

EXAMPLE 2

100 dried sheep skins are soaked for 12 to 14 hours with water at an inlet temperature of 28°–30° C. in a weight ratio of 1:20. Soaking can take place in a drum or in a vat. To each liter of soaking bath are added:

3.0 g of guanidine hydrochloride,
3.0 g of urea, and
0.5 g of alkaline bacterial proteinase from *Bacillus subtilis* (9,000 LVU). Ater a treatment time of one to two hours, agitation can be begun. However, it must be carried out such that there is no felting of the wool. The pH value of the soaking bath is 10.2 at the beginning and 9.2 at the end. After a 14 hour soaking period, the skins are flawlessly softened and show no fiber adhesion or hard spots.

EXAMPLE 3

100 Persian lamb skins, treated with bran and dried are softened in a drum for 10–12 hours with water having an inlet temperature of 20°–22° C. in a weight ratio of 1:20.

1.0 g of melamine,
1.0 g of urea,
0.08 g of alkaline bacterial proteinase from *Bacillus licheniformis* (9,000 LVU), and
0.08 g of alkaline fungal proteinase from *Aspergillus oryzae* (9,000 LVU) are added per liter of soaking bath.

After two hours of soaking, agitation is begun. Every hour, the batch is drummed for three minutes. The pH value of the bath is 10.8 at the beginning and 9.8 at the end. The skins at the end of the soaking are nicely loosened up and no longer show any hard spots.

EXAMPLE 4

1,000 dried mink pelts are softened for five hours in a drum with water at an inlet temperature of 24° C.–26° C. in a weight ratio of 1:20.

1.0 g of dicyandiamide and
1.0 g of urea are added per liter of soaking bath.

After one hour of soaking, agitation is begun. Every hour, the drum is rotated for five minutes. The pH value of the bath was 10.2 at the beginning and 9.5 at the end. At the end of the softening, the pelts are nicely softened, show no hair loosening and have no hard spots.

Instead of dicyandiamide, a corresponding amount of thiourea, thioacetamide, formamide, cyanourea, aminopyridine, aminopyrimidine, aminotriazole, aminoimidazole, or aminoindole can be used with comparable good results.

What is claimed is:

1. A method for soaking dried or salted fur pelts which consists essentially of soaking said pelts in an aqueous bath containing at least one compound selected from the group consisting of compounds of the formula

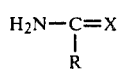

and acid addition salts of such compounds, wherein R taken alone is —H, —$NH_2$, —$CH_3$, or —NHCN, X taken alone is =O, =S, or =NH, and R and X taken together form a five- or six-membered heterocyclic ring having conjugated double bonds therein and containing only nitrogen as a hetero atom.

2. The method as in claim 1 wherein said aqueous bath contains at least one compound selected from the group consisting of urea, guanidine, dicyandiamide, acid addition salts of those compounds, and melamine.

3. The method as in claim 1 wherein said aqueous bath contains from 0.0075 to 0.1 mol per liter of said compound.

4. The method as in claim 1 wherein said aqueous bath contains from 0.01 to 0.085 mol per liter of said compound.

5. A method as in claim 1 wherein said aqueous bath additionally contains a proteolytic enzyme.

6. A method as in claim 5 wherein said proteolytic enzyme is a serine proteinase.

7. A method as in claim 5 wherein said proteolytic enzyme is an alkaline proteinase and said aqueous bath has a pH value between 9.0 and 10.8.

8. A method as in claim 7 wherein said alkaline proteinase is a serine proteinase.

9. A method as in claim 5 wherein said aqueous bath contains from 0.02 to 1.0 gram of said enzyme, per liter of said aqueous bath.

10. A method as in claim 1 wherein dried fur pelts are soaked for from 12 to 14 hours.

11. A method as in claim 1 wherein salted fur pelts are soaked for from 2 to 6 hours.

* * * * *